United States Patent [19]

Debetencourt

[11] Patent Number: 4,754,889

[45] Date of Patent: Jul. 5, 1988

[54] CONTAINER AND CAP

[75] Inventor: Jean Debetencourt, Maulde, Belgium

[73] Assignee: Lynes Holding S.A., Luxembourg-Great Duchy, Luxembourg

[21] Appl. No.: 38,751

[22] Filed: Apr. 15, 1987

[30] Foreign Application Priority Data

May 30, 1986 [BE] Belgium ..... 0/216725

[51] Int. Cl.[4] ..... B65D 41/50

[52] U.S. Cl. ..... 215/232; 215/250

[58] Field of Search ..... 215/250, 257, 226, 228, 215/232; 222/83, 81; 220/278, 277, 267; 206/222

[56] References Cited

U.S. PATENT DOCUMENTS

| | | | |
|---|---|---|---|
| 2,066,390 | 1/1937 | Cahoon et al. . | |
| 3,402,855 | 9/1968 | Schroeder et al. | 222/83 |

FOREIGN PATENT DOCUMENTS

| | | | |
|---|---|---|---|
| 1322352 | 2/1963 | France . | |
| 83084 | 4/1964 | France . | |
| 90028 | 8/1967 | France | 215/250 |
| 2049485 | 3/1971 | France . | |
| 318365 | 12/1956 | Switzerland | 215/250 |
| 2127387 | 4/1984 | United Kingdom . | |

*Primary Examiner*—Donald F. Norton

*Attorney, Agent, or Firm*—Fleit, Jacobson, Cohn & Price

[57] ABSTRACT

A cap adapted to cooperate with a container to seal and unseal the container. The cap comprises a circle-shaped knife carried by an inner surface of the cap and a lid adhesively secured to a portion of the inner surface of the cap. The container is sealed by positioning the cap over an opening of the container, which opening is defined by a container edge, and then securing the lid of the cap to the container edge by induction or conduction. The container is unsealed by exerting pressure on the cap whereby the knife cuts through the lid thereby cutting a circular portion out of the lid and unsealing the container. The circular portion cut out the lid remains adhesively secured to the cap.

8 Claims, 2 Drawing Sheets

CONTAINER AND CAP

This invention relates to a cap for closing by clipping-on a container, the opening of which is sealed by a lid secured thereto by induction or conduction.

The object of the invention is to provide a cap which has both the features of a tamper-proof cap, and further allows cutting open a heat-sealable lid which is secured by induction or conduction to the container opening.

For this purpose the cap according to the invention comprises on that side thereof facing in use position, said lid, a circle-shaped knife for cutting-out said lid when the cover is pushed down into the container, said container and cap having projections used for the so-called positioning and use clipping.

Still according to the invention, said knife is shaped as arched saw-teeth.

A feature of the invention lies in the cap being further provided with a tearable ring both to make the closure tamper-proof, and to prevent untimely driving the cap into the container and thus causing the lid to be cut-out.

Other details and advantages of the invention will stand out from the following description, given by way of non-limitative example and with reference to the accompanying drawings, in which:

FIG. 2 is a spread-out view of part of the knife the cap according to the invention is provided with.

Before starting with a detail description of the cap according to the invention, reference will be made to FIGS. 1 and 3, which show the two methods for securing a lid over the opening 2 from a container 3. There is meant here by "opening", the neck end of a bottle. It must be understood that any other opening location relative to the bottle and any other bottle shape fall within the scope of this Patent Application.

Figure 1:
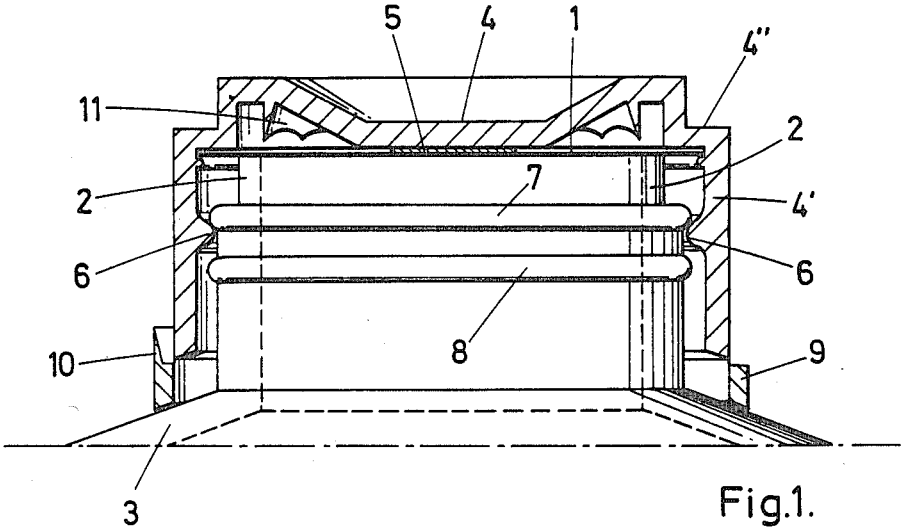
FIG. 1 is a section view of the cap according to the invention, closing by clipping-on the opening of a container fitted with a heat-sealable lid, secured by induction to the container opening.

As shown in FIG. 1, the lid 1 is secured to opening 2 by supplying heat through induction. The lid 1 is secured to the cap 4 with a glue spot 5. A keeper ring 6 is provided inside the cylinder-shaped portion 4' of cap 4. The lid 1 to be sealed is pressed against the top rim of opening 2 by the shoulder 4'' from cap 4. This results from the requirement of providing a space above opening 2, to go to what is conventionally called the opening step. Such support is obtained due to the presence of shoulder 4''.

Moreover, the cylinder-shaped portion 4' from cap 4 is provided with an inner projection 6 which cooperates with a so-called positioning outer projection 7, or with a so-called use outer projection 8.

The so-called positioning outer projection 7 retains the cap in that position wherein the unit is shown in FIG. 1.

The outer projection 8 retains the cap relative to the container, in the so-called use position.

At the bottom of cylinder-shaped portion 4', there is provided a tearable ring 9 provided with a gripping or tearing strip 10, which prevents the cap being driven into the container opening and thus also comprises an indicator showing the cap or closure has not been tampered with.

At the bottom of cap 4 there is provided a circle-shaped knife 11 which as long as the tearable ring 9 has not been removed, should not engage the lid 1.

Figure 2:
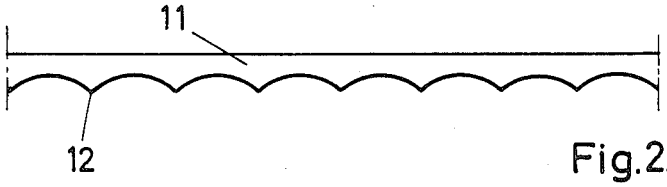

When the tearable ring 9 has been torn away, the user can press down the cap 4 the circle-shaped knife 11 of which will cut the lid 1 out. To obtain such cutting-out easily and without excessive strain, the circle-shaped knife 11 is provided with arched saw-teeth 12 which can be seen in the spread-out part view in FIG. 2.

When the cover 4 has been pushed-down and the lid 1 cut-out, the outer projection 7 is moved past the inner projection 6 and the cap is now retained due to cooperation between outer projection 7 and inner projection 6.

The outer diameter of circle-shaped knife 11 substantially corresponds to the inner diameter of opening 2 from container 3.

Figure 3:
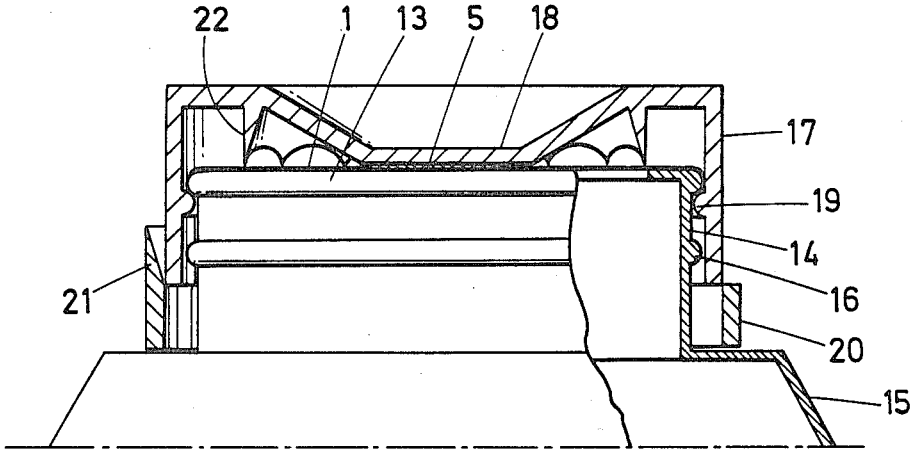
FIG. 3 is a section view of a cap closing by clipping-on the opening of a container fitted with a heat-sealable lid secured by conduction to the container opening.

A cap made according to the same principle is shown in FIG. 3, where it will be noted that the lid 1 has been secured by conduction to that projection 13 bounding the neck opening 14 from container 15. The container neck is provided with a second outer projection 16, while the cylinder-shaped portion 17 from cap 18 is provided with an inner projection 19 which is gripped between said outer projections 13 and 16 when cap 18 lies in that position as shown in FIG. 3, whereby the tearing ring 20 provided with a tearing strip 21, has not yet been removed from the cap.

The cap 18 as shown in FIG. 3, secured with a glue spot 5 to lid 1, is also provided as it is the case for cap 4 in FIG. 1, with an inner knife 22 which can cut the lid 1 out when the cap 18 is driven down into the opening of container 15 after tearing the ring 20 off.

The circle-shaped knife 22 is provided like circle-shaped knife 11, with the same arched teeth 12 to have pushing-down of cap 18 into container 15 cause without noticeable strain, cutting-out of said lid 1.

Figure 4:
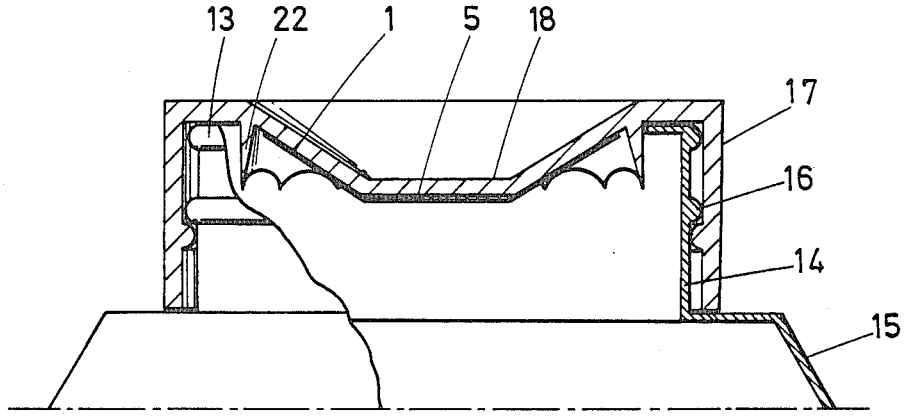
FIG. 4 is a section view of the cap according to the invention, showing that position thereof as pushed-down relative to the container opening.

FIG. 4 shows cap 18 pushed down into neck 14 from container 15.

In the embodiments as shown in FIGS. 1, 3 or 4, the outer diameter of circle-like knife 11, 22 is substantially equal to the inner diameter of the container opening, in such a way that when the cap has been pushed-down and the lid cut-out, the outer surface of circle-shaped knife 11, 22 forms a lip for closing the container opening back.

It must be understood that the invention is not limited to the above embodiments and that many changes might be brought thereto without departing from the scope of the invention as defined in the appended claims.

What is claimed is:

1. A cap adapted to cooperate with a container which has substantially cylindrical neck portion with an edge defining a container opening and a first projection and a second projection provided on an outer surface of said neck portion, said first projection being located between said second projection and said edge of the neck portion, said cap comprising:

a substantially cylindrical portion;

an open end defined by an edge of said cylindrical portion;

a closed end opposite said open end;

an inner projection provided on an inner surface of said cylindrical portion, said inner projection being adapted to cooperate with said first and second projections of said container;

a circle-shaped knife carried by an inner surface of said closed end of said cap such that said knife projects toward said open end of said cap;

a lid adhesively secured to a portion of the inner surface of said closed end such that said lid is interposed between said knife and said inner projection, said lid extending across said cylindrical portion of said cap;

wherein said container is sealed by securing said lid of said cap by induction or conduction to the edge of the neck portion of said container; and wherein when said container is sealed by said lid, said inner projection of said cap is retained between said first projection and said second projection of said neck portion of said container; and wherein the container is unsealed by exerting pressure on the closed end of said cap whereby the inner projection of said cap passes over the second projection of said neck portion of said container and the knife cuts through the lid thereby cutting a circular portion out of the lid and unsealing the container; and wherein the circular portion cut out of the lid remains adhesively secured to the portion of the inner surface of the closed end of the cap after the container is unsealed, thereby preventing the circular portion cut out of the lid from entering the container.

2. A cap of claim 1, wherein said circle-shaped knife is provided with arched saw-teeth.

3. A cap of claim 1, further comprising a tearable ring provided adjacent the open end of said cap, said tearable ring providing tamper-proof sealing of the container and preventing unintentional unsealing of the container.

4. A cap of claim 1, wherin the circle-shaped knife is arranged along a circle having an outer diameter which corresponds substantially to an inner diameter of the substantially cylindrical neck portion of said container.

5. A container and cap combination, comprising:

a container having a substantially cylindrical neck portion with an edge defining a container opening, and a first projection and a second projection provided on an outer surface of said neck portion, said first projection being located between said second projection and said edge of the neck portion; and a cap mounted on the cylindrical neck portion of said container, said cap having:

a substantially cylindrical portion, an open end defined by an edge of said cylindrical portion, a closed end opposite said open end, an inner projection provided on an inner surface of said cylindrical portion, said inner projection cooperating with said first and second projections of said container, a circle-shaped knife carried by an inner surface of said closed end of said cap such that said knife projects toward said open end of said cap, and a lid adhesively secured to a portion of the inner surface of said closed end such that said lid is interposed between said knife and said inner projection, said lid extending across said cylindrical portion of said cap, and said lid of said cap being sealed to the edge of the neck portion of said container by induction or conduction; and wherein said inner projection of said cap is retained between said first projection and said second projection of said neck portion of said container; and wherein the container is unsealed by exerting pressure on the closed end of said cap whereby the inner projection of said cap passes over the second projection of said neck portion of said container and the knife cuts through the lid thereby cutting a circular portion out of the lid and unsealing the container; and wherein the circular portion cut out of the lid remains adhesively secured to the portion of the inner surface of the closed end of the cap after the container is unsealed, thereby preventing the circular portion cut out of the lid from entering the container.

6. A container and cap combination of claim 5, wherein said circle-shaped knife is provided with arched saw-teeth.

7. A container and cap combination of claim 5, further comprising a tearable ring provided adjacent the open end of said cap, said tearable ring providing tamper-proof sealing of the container and preventing unintentional unsealing of the container.

8. A container and cap combination of claim 5, wherein the circle-shaped knife is arranged along a circle having an outer diameter which corresponds substantially to an inner diameter of the substantially cylindrical neck portion of said container.

* * * * *